US011131947B2

(12) United States Patent
Rosenwein et al.

(10) Patent No.: US 11,131,947 B2
(45) Date of Patent: Sep. 28, 2021

(54) TRANSFERRING PRINT AGENT USING FIRST AND SECOND TRANSFER MEMBERS

(71) Applicant: HP Indigo B.V., Amstelveen (NL)

(72) Inventors: Eyal Rosenwein, Ness Ziona (IL); Matan Schneider, Ness Ziona (IL); Lavi Cohen, Ness Ziona (IL); Alex Feygelman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/606,758

(22) PCT Filed: Sep. 13, 2017

(86) PCT No.: PCT/EP2017/073058
§ 371 (c)(1),
(2) Date: Oct. 20, 2019

(87) PCT Pub. No.: WO2019/052644
PCT Pub. Date: Mar. 21, 2019

(65) Prior Publication Data

US 2020/0201210 A1 Jun. 25, 2020

(51) Int. Cl.

| | |
|---|---|
| ***G03G 15/16*** | (2006.01) |
| ***G03G 15/10*** | (2006.01) |
| ***G03G 15/11*** | (2006.01) |

(52) U.S. Cl.
CPC ..... *G03G 15/169* (2013.01); *G03G 15/104* (2013.01); *G03G 15/11* (2013.01); *G03G 15/161* (2013.01)

(58) Field of Classification Search
CPC ..... G03G 15/10; G03G 15/108
See application file for complete search history.

(56) References Cited

U.S. PATENT DOCUMENTS

| | | | | |
|---|---|---|---|---|
| 4,974,027 | A | 11/1990 | Landa et al. | |
| 5,369,476 | A | 11/1994 | Bowers et al. | |
| 5,991,582 | A * | 11/1999 | Liu | G03G 15/11 399/237 |
| 6,070,042 | A * | 5/2000 | Landa | G03G 5/04 399/302 |
| 7,375,857 | B1 | 5/2008 | Pinard et al. | |
| 7,573,589 | B2 | 8/2009 | Morales et al. | |
| 9,052,851 | B1 | 6/2015 | Varga et al. | |
| 9,114,603 | B2 | 8/2015 | Smith | |
| 2009/0027705 | A1 | 1/2009 | Ozaki et al. | |

FOREIGN PATENT DOCUMENTS

| | | |
|---|---|---|
| WO | WO-2005040940 A1 | 5/2005 |
| WO | WO-2017016599 A1 | 2/2017 |

* cited by examiner

*Primary Examiner* — Walter L Lindsay, Jr.
*Assistant Examiner* — Andrew V Do
(74) *Attorney, Agent, or Firm* — Middleton Reutlinger

(57) ABSTRACT

In an example, a method includes collecting (102) print agent from a print agent reservoir to form a print agent layer on a first print agent transfer member (204). The print agent layer may be transferred (104) directly from the first print agent transfer member to a second print agent transfer member (206), where the print agent layer may be heated (106). The print agent layer may be applied (108) directly from the second print agent transfer member to a substrate.

13 Claims, 7 Drawing Sheets

TRANSFERRING PRINT AGENT USING FIRST AND SECOND TRANSFER MEMBERS

BACKGROUND

In printing, print agents such as inks, toners, coatings and the like may be applied to a substrate. Substrates may in principle comprise any material, for example comprising paper, card, plastics, fabrics or the like.

In some examples, a 'proof' of a print agent may be printed. For example, an ink or some other colorant may be mixed and a test print may be printed such that the colorimetry of the printed agent may be determined by measurement or the like.

BRIEF DESCRIPTION OF DRAWINGS

Non-limiting examples will now be described with reference to the accompanying drawings, in which.

DETAILED DESCRIPTION

Figure 1:
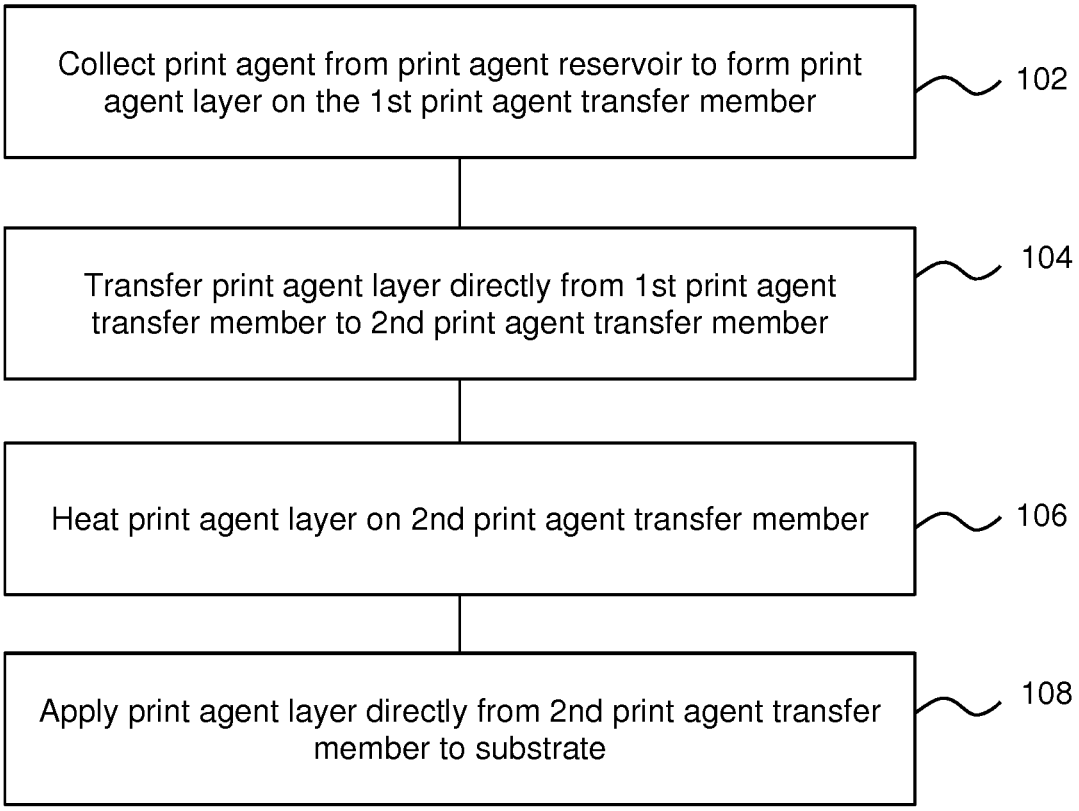
FIG. 1 shows an example of a method for transferring a print agent from a print agent reservoir to a substrate.

In some examples of printing techniques, charged print agents, such as charged toner particles or resins, may be applied to a conducting (in some examples, a charged photoconductive) surface. In some examples, such print agents are subsequently transferred (in some example via at least one intermediate transfer member) to a substrate.

For example, a print apparatus may comprise an electrophotographic print apparatus such as a Liquid Electro Photographic (LEP) print apparatus which may be used to print a print agent such as an electrostatic printing fluid or composition (which may be more generally referred to as "an electronic ink" in some examples). Such a printing fluid may comprise electrostatically charged or chargeable particles (for example, resin or toner particles which may be colored particles) dispersed in a carrier fluid. A photo charging unit may deposit a substantially uniform static charge on a photoconductive surface (which may be termed a photo imaging plate, or 'PIP'). In some examples, such a charge is transferred to the photoconductive surface via a charge transfer roller which is in contact with the photoconductive surface, although non-contact methods of charge transfer may be used. A write head, which may for example comprise at least one laser, may be used to dissipate the static charge in selected locations of the image area on the photoconductive surface to leave a latent electrostatic image.

The electrostatic printing fluid composition (generally referred to herein a 'print agent') is transferred to the photoconductive surface from a print agent source using a print agent supply unit (which may be termed a Binary Ink Developer (BID) unit in some examples), which may present a substantially uniform film of the print agent to the photoconductive surface for example via a print agent application roller.

In an example, a resin component of the print agent may be electrically charged by virtue of an appropriate potential applied to the print agent in the print agent source. The charged resin component, by virtue of an appropriate potential on the electrostatic image areas of the photoconductive surface, is attracted to a latent electrostatic image on the photoconductive surface. In one example, the print agent does not adhere to the charged areas and forms an image in print agent on the photoconductive surface in the uncharged locations. The photoconductive surface will thereby acquire a developed print agent electrostatic ink composition pattern on its surface.

In some examples, the pattern may then be transferred to an Intermediate Transfer Member (ITM), by virtue of pressure and/or an appropriate potential applied between the photoconductive surface and the ITM such that the charged print agent is attracted to the ITM. The ITM may for example comprise a loop, which may be a 'blanket' comprising a rubber layer, for example arranged about rollers or provided on the surface of a drum, or the like. The ITM may be urged towards the photoconductive surface to be in close proximity or in contact therewith.

In some examples, the print agent pattern may be dried and/or at least partially fused on the ITM before being transferred to a substrate (for example, adhering to the colder surface thereof).

As will be appreciated from the above description, such print apparatus comprises several stages and many interacting components. In particular, in the above example, print agent is formed into an intended pattern on the photoconductive surface, which is associated with charging rollers, lasers and the like. However, in some cases there may be no need to form a pattern. For example, when printing a 'color proof' of a print agent, a continuous region of the print agent may be printed (and, in some example, may be printed at maximum coverage). This may be attained by removing the charge from a continuous region of the photoconductive surface using the apparatus above, but in general, the same methods and the same apparatus are used to produce this color proof as would be used in producing text, patterns, complex images and the like.

FIG. 1 is an example of a method in which the photoconductive surface is omitted from a print operation (and may be omitted, along with its ancillary components, from print apparatus in some examples thereof, as is described herein after).

Block 102 comprises collecting print agent from the print agent reservoir to form a print agent layer on a first print agent transfer member. In some examples, the print agent may be a liquid print agent, for example an electronic ink. In other examples, the print agent may comprise a toner or the like. The reservoir may be any source of print agent.

In examples, the print agent reservoir may comprise a void through which print agent may flow. The first print agent transfer member may for example comprise a drum or cylinder, for example comprising a metal, cylindrical drum, or comprising a metal core. An electrode (the first electrode) may be provided within the print agent reservoir in order to charge the print agent. The first print agent transfer member may act as a second electrode, and be held at an appropriate relative potential such that print agent is attracted to the surface thereof. In some examples, the print agent reservoir may be formed such that the electrode and/or void follows the shape of the first print agent transfer member.

Block 104 comprises transferring the print agent layer directly from the first print agent transfer member to a second print agent transfer member. For example, the transfer may occur as a result of a nip being formed between the first and second print agent transfer members (i.e. under pressure). In some examples, the transfer may be facilitated by virtue of an appropriate electric potential. The second print agent transfer member may for example comprise a generally circular cylinder, which in some examples may have a cut-off portion, such that the cylindrical body has a flattened circumferential portion. The second print agent transfer member may, in some examples, comprise a rubber or rubber like outer surface to which the print agent layer is transferred. In some examples, the second print agent transfer member may be held at an electrical potential so as to enhance the transfer of print agent from the first print agent transfer member thereto.

Block 106 comprises heating the print agent layer on the second print agent transfer member. In some examples, this may comprise heating the print agent layer as it rotates on the second print agent transfer member. In some examples, heat may be applied in some regions of the transport path and not in others.

Block 108 comprises applying the print agent layer directly from the second print agent transfer member to a substrate. At the point of transfer, the print agent layer may be at least partially dried or fused by the heating carried out in block 106. In some examples, the substrate may be a relatively small scale substrate, for example comprising an A5 substrate, a postcard sized substrate, or smaller, e.g. 30 by 150 mm (approximately 'credit card' size). In some examples, the transfer may be made under pressure, for example by introducing a substrate into a nip formed between the first and second print agent transfer members.

In some examples, the method may comprise controlling the apparatus such that the surfaces of both the first and second print agent transfer members are consistently at respective first and second potentials (i.e. the whole surface is at substantially the same potential).

For example, an electrode in the print agent reservoir may be at a first voltage, the first print agent transfer member may be at a second voltage, which is higher than the first voltage and the second first print agent transfer member may be at third voltage, which is higher than the second voltage. Thus the voltage may increase through print agent transfer stages. While any voltages having such a pattern may be used in such examples, in some examples, the first voltage may be negative, the second voltage may be ground and the third voltage may be positive.

As will be appreciated, this method may result in a continuous region of a particular print agent being printed. While this means that the apparatus is not suitable for producing images in the same way as a photoconductive surface, inkjet printer or the like (e.g. for producing text, or highly controllable patterns and the like), it may be useful for proofing exercises and the like.

However, it may be noted that a variable printed image can be produced by varying some print apparatus parameters, such as by varying the distance between the first print agent transfer member and the electrode. In one example, the relative positions of first print agent transfer member and the electrode is fixed, and the distance between the first print agent transfer member and the electrode varies along the length of the electrode (for example, the electrode may comprise a curved electrode which is positioned eccentrically to the curve of a surface of the first print agent transfer member). Such an arrangement may be provided to produce a variable tone print. For example, the distance between the electrode and the first print agent transfer member may vary so as to obtain a print agent layer having a variable thickness. This may allow a single print to serve as a 'proof' for a plurality of tones of a print agent.

Figure 2:
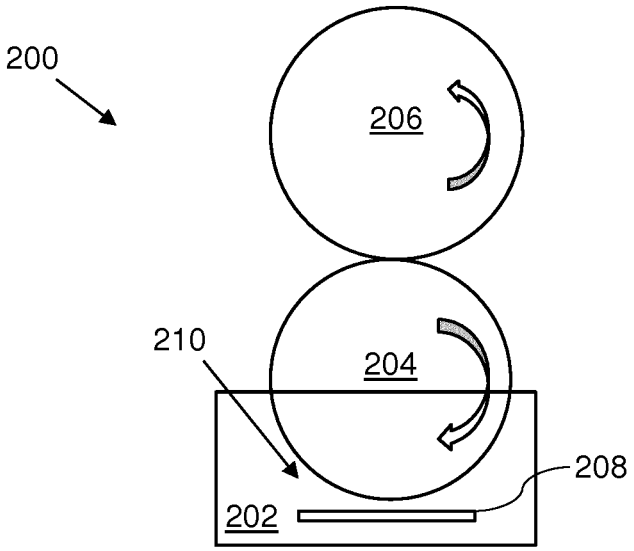
FIG. 2 shows an example of a print apparatus.

FIG. 2 shows an example of a print apparatus 200 comprising a print agent cell 202, a first print agent transfer member 204 and a second print agent transfer member 206. The print agent cell 202 comprises an electrode 208 and a void 210, wherein the electrode 208 is to impart an electrostatic charge on a print agent within the void 210.

The first print agent transfer member 204 is, in operation of the print apparatus 200, to acquire a layer of print agent from the print agent cell 202 on the surface thereof. In this example the first print agent transfer member 204 comprises a cylinder, for example comprising a stainless steel metal cylinder. The surface of the first print agent transfer member 204 may, in use of the apparatus, be at a substantially consistent potential, for example being grounded.

The second print agent transfer member 206 is, in operation of the print apparatus 200, to receive the layer of print agent from the first print agent transfer member and to transfer the layer of print agent to a substrate. In this example, the second print agent transfer member comprises a cylinder, the curved surface of which, in use of the apparatus, may be held at a substantially consistent potential, which may be a positive voltage.

In this example, both the first 204 and the second 206 print agent transfer members rotate about respective centres of rotation. They may be relatively positioned such that a nip is formed between the transfer members 204, 206 in order to effect the transfer of print agent from the first to the second transfer member.

Figure 3:
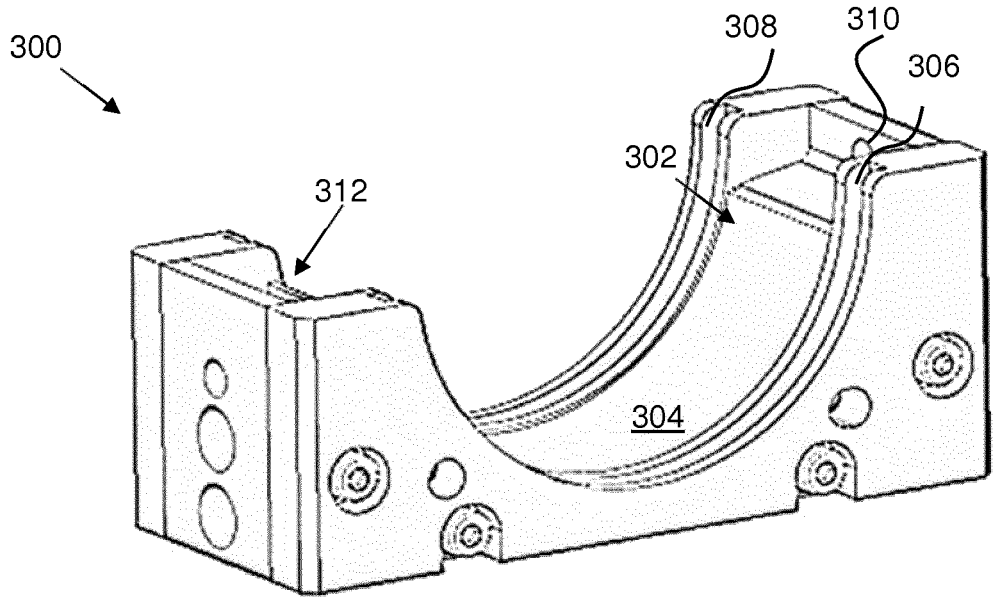
FIG. 3 shows an example of a print agent cell.

FIG. 3 shows an example of a print agent cell 300, which may act as the print agent cell 202 in the apparatus 200 described in FIG. 2. The print agent cell 300 comprises a void 302 formed between an electrode 304 (in this example, comprising a curved conductive plate) and sidewalls 306, 308. In this example, the void 302 is a curved void, which follows the shape of a first print agent transfer member to be used with the print agent cell 300, and the electrode 304 follows the base of the void 302 but this need not be the case in all examples. For example, the void 302 could be any shape, while still comprising a curved electrode 304 (or some other form of electrode which follows the shape of a first print agent transfer member to create a layer of constant thickness, or which differs therefrom to create a variable thickness layer, and thereby a variable tone print).

The print agent cell 300 comprises a print agent inlet 310 and a print agent overflow 312. The print agent inlet 310 is higher than the print agent overflow 312. The sidewall 306, 308 are intended to contact a first print agent transfer member such that the void 302 is between the curved outer surface of the first print agent transfer member and the electrode 304. The sidewalls 306, 308 are relatively rigid, and in this example comprise a 'double wall' feature at an upper edge to assist with sealing. In some examples, the print agent cell 300 may be biased towards a first print agent transfer member. Providing relatively rigid sidewalls 306, 308 means that the void 302 is well-defined (and in this example, consistent), in turn enabling formation of a print agent layer having repeatable characteristics to be acquired by a first print agent transfer member.

The distance between the electrode 304 and the intended position of the surface of the first print agent transfer member in this example is consistent, and therefore a print agent layer of constant thickness may be acquired. However, in some examples, this distance may vary so as to produce a variable tone print. For example the curve of the electrode 304 may be eccentric to a curve of a first print agent transfer member surface.

In some examples, the void 302 may have a volume of around 2 to 8 ml, and a height of around 500 to 1000 μm.

Figure 4A:
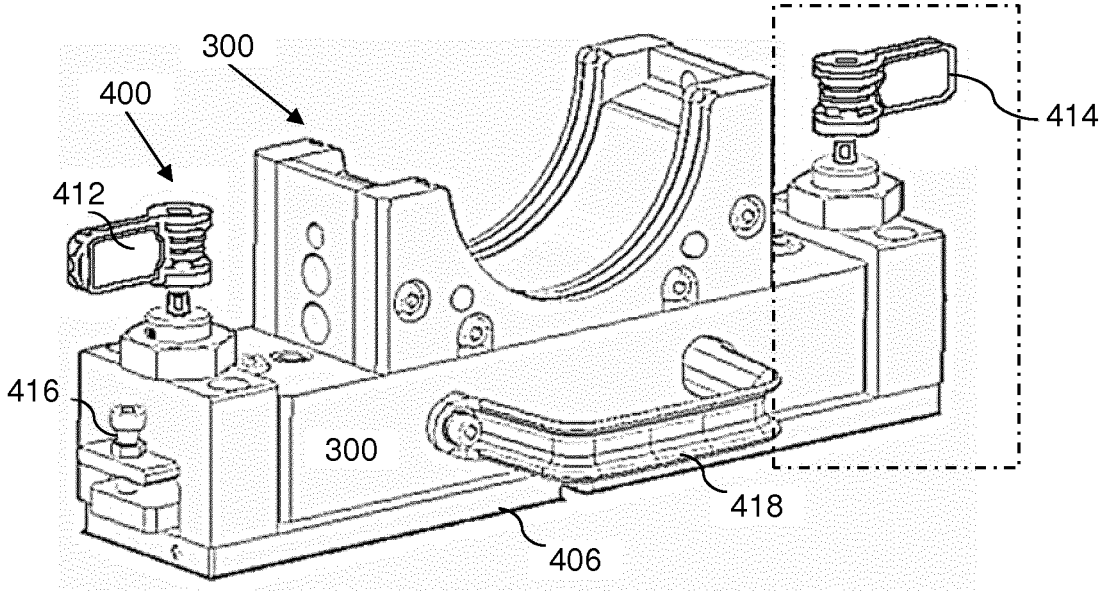
FIGS. 4A and 4B show an example of a mounting for a print agent cell.
Figure 4B:
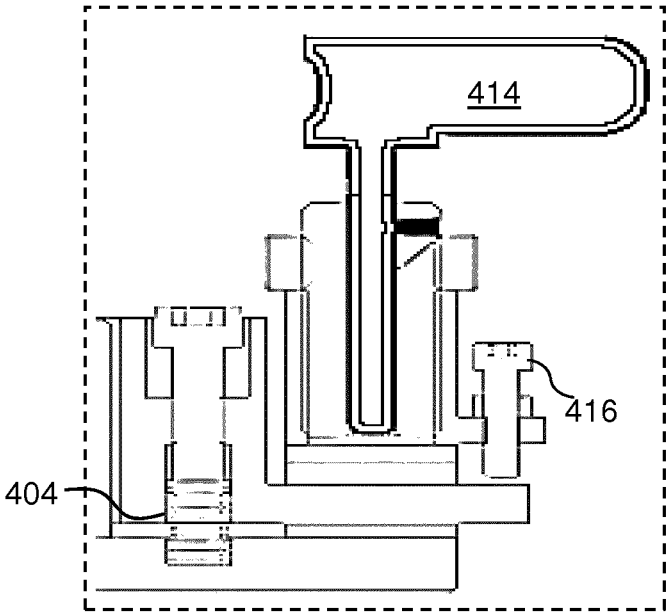

FIGS. 4A and 4B show, respectively, a perspective view of a mounting 400 for a print agent cell 300 and a cut through view of a portion of the mounting 400 (the portion shown in a dotted outline box in FIG. 4A). The print agent cell 300 is biased upwards by springs 404 (only one of which is shown in FIG. 4B) mounted on a platform 406. Plungers 412, 414, are provided to removably mount the print agent cell 300 to the platform 406, such that the plungers 412, 414 can control the vertical position of the print agent cell 300. Stop pins 416 limit the vertical travel of the print agent cell 300 and prevent the print agent cell 300 from turning with a first print agent transfer member, noting that the position of the print agent cell 300 relative to the platform 406 will be determined by a first print agent transfer member acting on the sidewalls 306, 308 in this example. The mounting 400 is provided with a handle 418, such that it is readily removable from the platform 406 when the plungers 412, 414 are released. This may for example facilitate removal for cleaning or the like.

Figure 5:
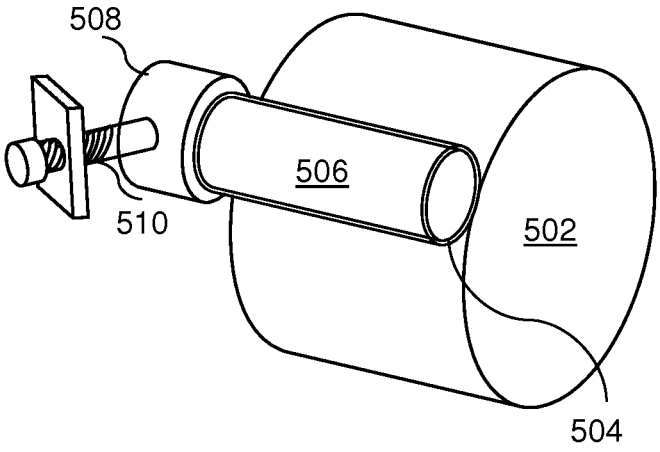
FIG. 5 shows an example of a first print agent transfer member.

FIG. 5 shows an example of first print agent transfer member 502 and an associated squeegee roller 506. In this example, the first print agent transfer member 502 is driven by a drive assembly, for example comprising a servomotor, although in other examples of the motors may be provided. The surface of the first print agent transfer member 502 in this example has a surface roughness of around N5. In general, the surface roughness may be selected so as to substantially correspond to the surface roughness of a print apparatus on which a print agent under test is to be subsequently printed. In other words, the first print agent transfer member 502 may be selected so as to reproduce the intended properties of a print apparatus to be used to print patterns of the print agent. In this example, the print agent transfer member 502 comprises a stainless steel body.

In this example, the squeegee roller 506 is mounted in a housing 508. The housing is pressed towards the first print agent transfer member 502 under a biasing force, in this example provided by a positioning screw 510. The squeegee roller 506 is a 'soft' squeegee, having a polyurethane surface 504 which deflects under pressure, creating an appropriate 'nip' between the squeegee roller 506 and the surface of the first print agent transfer member 502. This surface 504 also provides a low conductivity layer between the squeegee roller 506 and the first print agent transfer member 502. In other examples, an insulative, or low conductivity, layer may be provided on the first print agent transfer member 502, and the squeegee roller 506 may be a metal roller.

In operation of the apparatus, the squeegee roller 506 may be held at a voltage, which may be a negative potential of for example around −100 V to −300 volts, or any force which repels print agent. The squeegee roller 506 may apply a predetermined force on the first print agent transfer member 502, which may be controlled by adjusting a positioning screw 510 which acts on housing 508. The force applied by the squeegee roller 506 to the first print agent transfer member 502, and the force applied by the potential, may be intended to mimic the forces applied by a squeegee roller of a print apparatus to be subsequently used in printing print agent patterns using the print agent under test. In other words, and more generally with respect to the apparatus described herein, conditions in the print apparatus described herein may be selected so as to mimic conditions in a print apparatus in which the print agent under test is to be used in printing images, text, and the like.

For example, the force applied may be on the order of 3 to 15 N per metre. The size of a gap between the squeegee roller and the first print agent transfer member 502 may also be selected to mimic subsequent print conditions, for example being set to around 100 to 200 μm. The squeegee roller 506 may be intended to provide a relatively uniform print agent layer on the first print agent transfer member 502. To that end, there may be a speed difference between the squeegee roller 506 and the first print agent transfer member 502 as such a speed difference has been found to assist in spreading the print agent layer to encourage uniformity thereof.

Therefore, in this example, the layer of print agent is squeezed both by the force applied by the squeegee roller 506 and the electrical force applied by the potential of the squeegee roller 506.

As noted above, in some examples, an outer layer may be provided on at least one of the first print agent transfer member 502 and the squeegee roller 506, providing some insulation, or with a low conductivity layer, in particular if otherwise they could be contact between conductive surfaces. The first print agent transfer member 502 and/or the squeegee roller 506 may for example be painted or coated with such a low conductivity layer in order to ensure that appropriate electrostatic conditions are maintained.

Figure 6A:
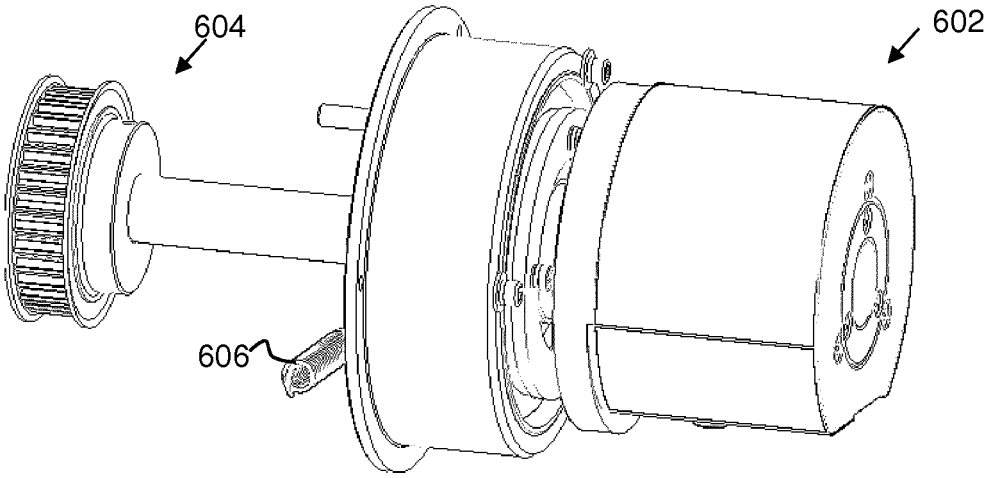
FIGS. 6A-6C show an example of a second print agent transfer member.
Figure 6B:
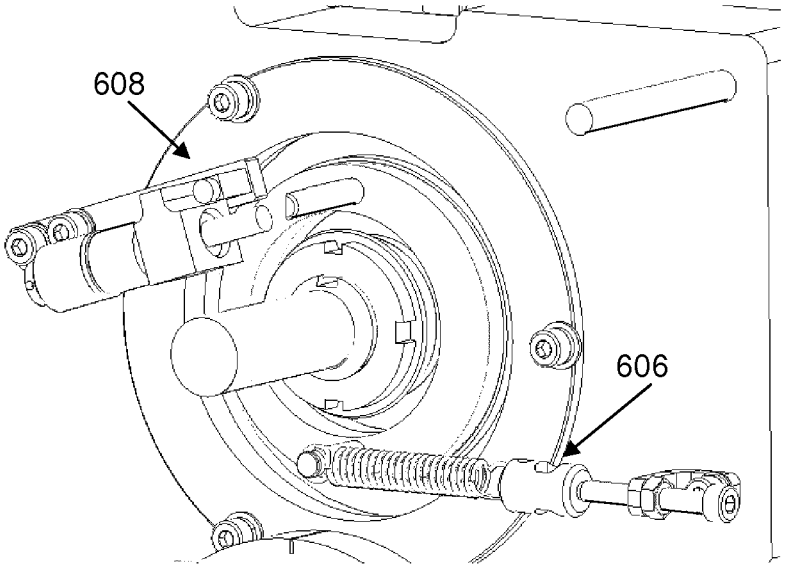
Figure 6C:
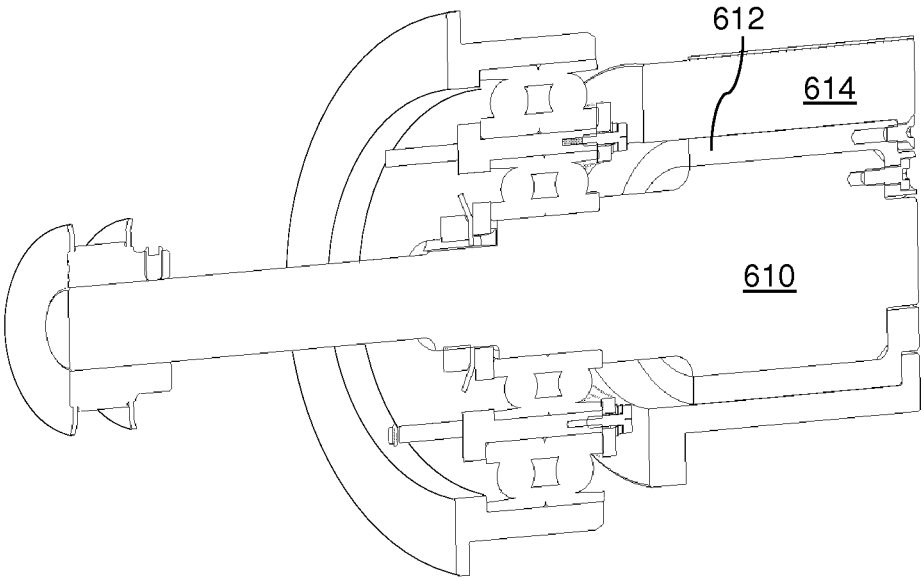

FIG. 6A shows an example of a second print agent transfer member 602 and associated drive assembly 604. FIG. 6B shows a mounting arrangement for the second print agent transfer member 602. FIG. 6C shows a cross-section illustrating a core structure of the second print agent transfer member 602.

In this example, the second print agent transfer member 602 has a cut-off cylinder shape, which provides a flattened portion of the cylinder shape (which is in its lowermost position as shown in FIG. 6A). This shape could alternatively be described as a cam third circular shaft. This shape limits heat transfer between the first and second print agent transfer members. Specifically, by providing a gap between the first and second print agent transfer members at least part of their rotational cycles, the surface of the second print agent transfer member 602 can cool after heating, and/or the surfaces may be separated during heating. In other examples, this effect could instead be achieved in some other way, for example by mounting the second print agent transfer member 602 on a shifting mounting. It may be noted that, in a liquid electro photographic printing apparatus, as has been described above, cleaning stations may be provided in association with the ITM. These cleaning stations cool the ITM surface before it contacts the photoconductive surface. However, in this example, no such cleaning station is provided. Moreover, this cut-off shape 'cam' shaped curve provides for ease of engagement of a substrate, as is described below.

In an example, a drive system of the second print agent transfer member 602 may comprise a motor, such as a servomotor, and a pulley, which may be connected to a pulley attached to the second print agent transfer member core using a timing belt running about the drive assembly 604. In such an example, there may be a 1:1 ratio between the motor and the second print transfer member 602.

In this example, and as is best shown in FIG. 6B, which shows an example mounting for the second print agent transfer member 602, the second print agent transfer member 602 is mounted using a spring 606 and is positionable relative to a hard stop 608 (which may itself have an adjustable position). In this example, a force is applied eccentrically to the second print agent transfer member 602 to allow vertical adjustment of the second print agent transfer member 602 (in other words, distance between mountings the first print agent transfer member and the second print agent transfer member is adjustable). This in turn affects the nip force between the first 502 and second 602 print agent transfer members. In other words, in use, the first and second print agent transfer members 502, 602 may engage (for at least part to the respective rotations) with adjustable force. However, in other examples, the pressure between the first and second print agent transfer members 502, 602 may be predetermined, for example being fixed for the life of an apparatus.

As is best shown in FIG. 6C, which shows a cut through view of the second print agent transfer member 602, in this example, the second print agent transfer member 602 comprises a core 610, a thermal insulation layer 612, and an outer layer 614.

The thermal insulation 612 layer is provided to limit heat transfer from the outer layer to the core 610 (and therefore potentially to other components of the apparatus). The thermal insulation layer 612 may comprise a plastic, which may be selected for its thermal insulation properties. The core 610 may comprise a material selected for strength and endurance, for example comprising stainless steel.

The outer layer 614 in this example comprises a rubber-like coating, which may comprise a rubberised sheet or the like which may be adhered to a core structure.

In this example, the surface of the second print agent transfer member 602 may, in use of the apparatus, be positive voltaged, and held at a consistent potential.

While one example of a second print agent transfer member 602 is described, there are many possible alternatives. One such example comprises a roller with relatively thick end and thermal insulation arranged between the roller and a bearing supporting the roller.

Figure 7:
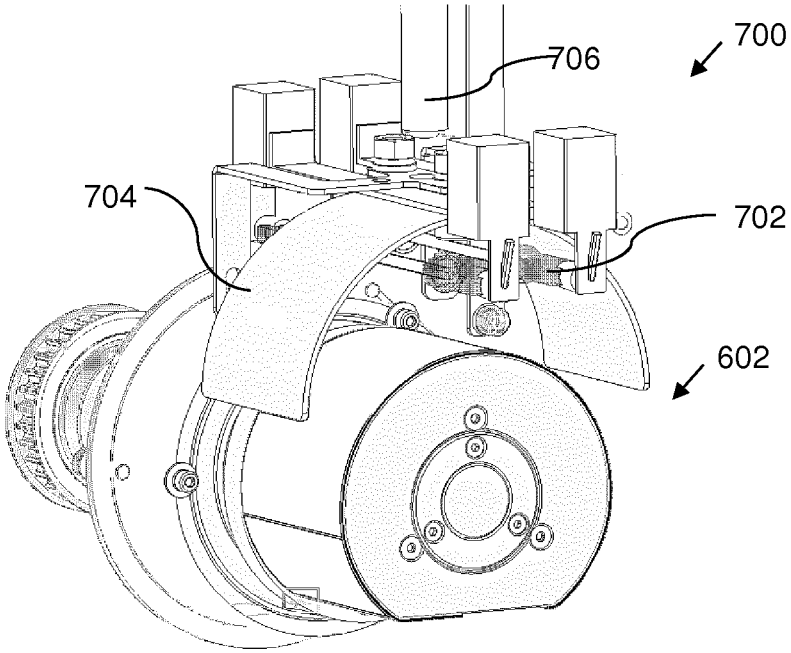
FIG. 7 shows an example of a second print agent transfer member in conjunction with example heating apparatus.

FIG. 7 shows the second print agent transfer member 602 in conjunction with heating apparatus 700. In this example the heating apparatus 700 comprises two halogen lamps 702 (one of which is labelled) which may for example be 500 W halogen lamps, a heat shield/reflector 704 to concentrate the output of the lamps 702, and an IR sensor 706. The IR sensor 706 monitors the temperature of the surface of the second print agent transfer member 602 and may switch the halogen lamps 702 accordingly.

In this example, heat is applied around to a portion of the circumference of the second print agent transfer member 602 (rather than about the whole circumference). Therefore, as a print agent layer rotates, it is over a portion of the rotation that heating occurs (and rotation may cease during heating). The heating time may vary according to the speed of the second print agent transfer member. This may in some examples comprise around 5-80 rpm, and the heating time may vary between a few seconds to few minutes. In some examples a maximum temperature of around 75 to 110° C. may be reached, depending on the print agent. Inefficiency in heat transfer means that the lamps may be at a higher temperature.

The heat provided by the halogen lamps may evaporate a carrier fluid (for example imaging oil) within the print agent. This may in turn increase the proportion of solid component of the print agent. In some examples heating may cause melting and/or fusion of particles within the print agent. For example, following heating, the print agent may be at least partially dried and fused to form a plastic-like layer.

While in this example, the second print agent transfer member 602 is irradiated with heat lamps, this need not be the case in all examples. For example, heating elements may be provided inside the second print agent transfer member, or the surface itself may comprise heating elements, or the like.

Figure 8A:
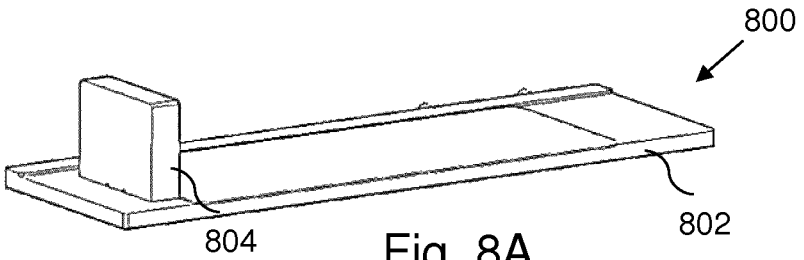
FIGS. 8A and 8*b* show an example of a substrate handling apparatus.
Figure 8B:
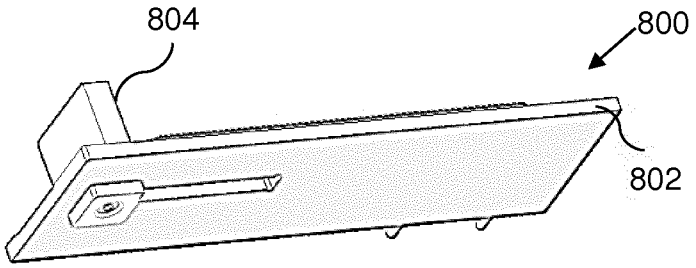

FIGS. 8A and 8B show different views of an example of a substrate handling apparatus 800, in this case comprising a tray 802 having a manually operated push plate 804. In use of a print apparatus, the substrate handling apparatus 800 is to introduce a substrate between the first and second print agent transfer members. The tray 802 is positioned close to the nip between the first and second print agent transfer members and a substrate, in this example a relatively small paper sheet, is placed on the tray 802. In some examples, in order to increase the resistance of the sheet to buckling and the like, a substrate may be fixed (for example, glued) to a relatively rigid plate (for example an aluminium sheet), and the assembly may be placed on the tray 802. By operation of the plate 804, the paper is caught within the nip and receives the print agent layer (in this example, being an at least partially dried print agent layer) from a second print agent transfer member.

The print agent layer may transfer under the force of around 3,450-12,000 N per metre. As the first and second print agent transfer members in the example apparatus described in FIGS. 3 to 8 in this example relatively rotate opposite directions in use of the apparatus, the substrate travels in a direction tangential to the surfaces of both the transfer members.

In order to coordinate insertion of the substrate, in this example, the operation of the print apparatus may cease. In particular, the operation may cease at the point that the second print agent transfer member bears a heated layer of print agent, for example, when an intended melting point of a print agent has been acquired. There may be separation between the first and second print agent transfer members at this point (for example provided by a flattened portion of the second print agent transfer member).

The substrate (or substrate assembly) may thereby be passed through and then ejected from the nip, for example onto a second tray positioned on the other side of the nip between the first and second print agent transfer members, now bearing a layer of print agent which has been transferred from the second print agent transfer member.

This is just one example of a possible example of substrate handling apparatus. In another example, the substrate may for example be wrapped around a roller, which is urged against the second print agent transfer member, or a substrate may be pressed against the second print agent transfer member in some other way.

In this and some other examples, the substrate handling apparatus may be manually operated. This may allow the substrate handling apparatus to be relatively small, such that it does not unduly increase the size of the print apparatus in which it is installed.

Figure 9:
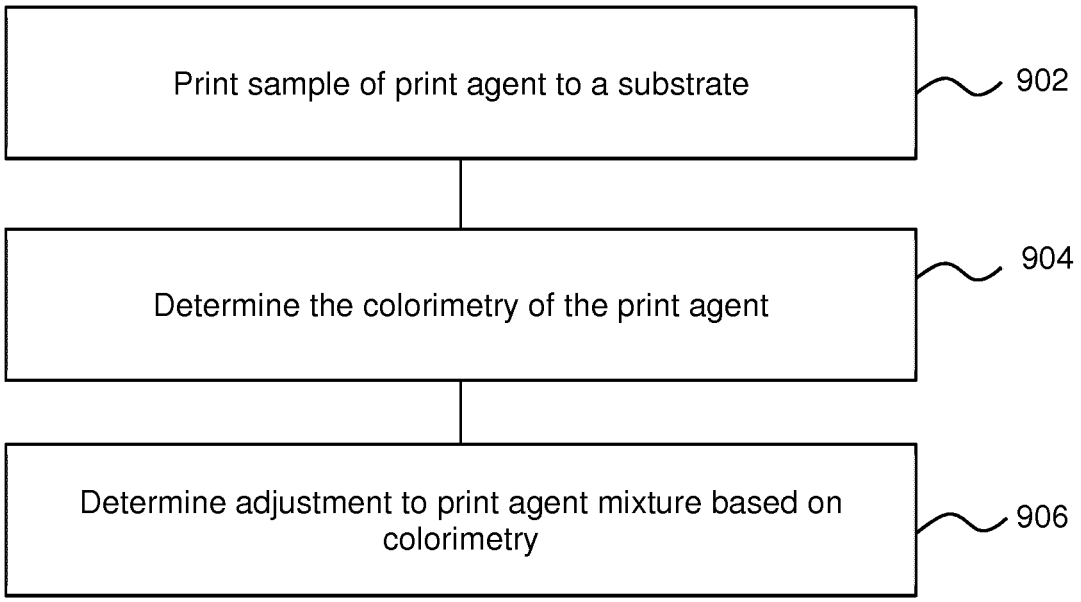
FIG. 9 shows an example of a method of use of a print apparatus.

FIG. 9 shows an example of a method of use of the apparatus, in block 902, a sample print agent is printed to a substrate. This may be printed using the apparatus described above, and/or by the method of FIG. 1.

In block 904, the colorimetry of the print agent on the substrate is determined. This may for example be determined using a colorimeter or in some other way.

In block 906, an adjustment to a print agent mixture is determined based on the colorimetry. For example, if the colorimetry departs from an intended colorimetry by more than a threshold amount, an adjustment may be made to a print agent makes such that the print agent more closely conforms, when printed, to intended colorimetry.

Figure 10:
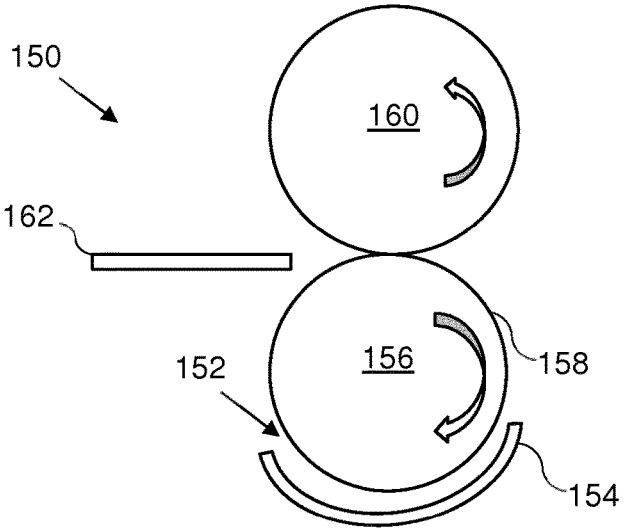
FIG. 10 shows an example of a color proofing apparatus.

FIG. 10 shows a color proofing apparatus 150 comprising a fluid reservoir 152 for receiving an electrostatic liquid ink composition. The fluid reservoir 152 comprising an electrode 154 to charge the electrostatic ink composition and may have any of the features for the print agent cell of FIG. 2 or 3.

The color proofing apparatus 150 further comprises a developer drum 156. The developer drum 156 may have any of the features of a first print agent transfer member described above. In this example the developer drum 156 has a surface 158 to contact the electrostatic liquid ink within the fluid reservoir 152, and acquire a layer of the electrostatic liquid ink composition therefrom.

The color proofing apparatus 150 further comprises an intermediate transfer member 160. The intermediate transfer member 160 may have any of the features of the second print agent transfer member described above. In this example, the intermediate transfer member 160 is, in use of the apparatus 150, to receive the layer of the electrostatic liquid ink from the developer drum 156 and to transfer the layer to a substrate. In some examples, the intermediate transfer member 160 may be associated with heating apparatus.

The color proofing apparatus 150 further comprises a substrate handling apparatus 162. The substrate handling apparatus 162 may, in some examples, be at least in part manually operated, and may comprise any of the features of the substrate handling apparatus described above. In this example, the substrate handling apparatus is to insert a substrate between the intermediate transfer member 160 and the developer element, in this example a developer drum 156.

Figure 11:
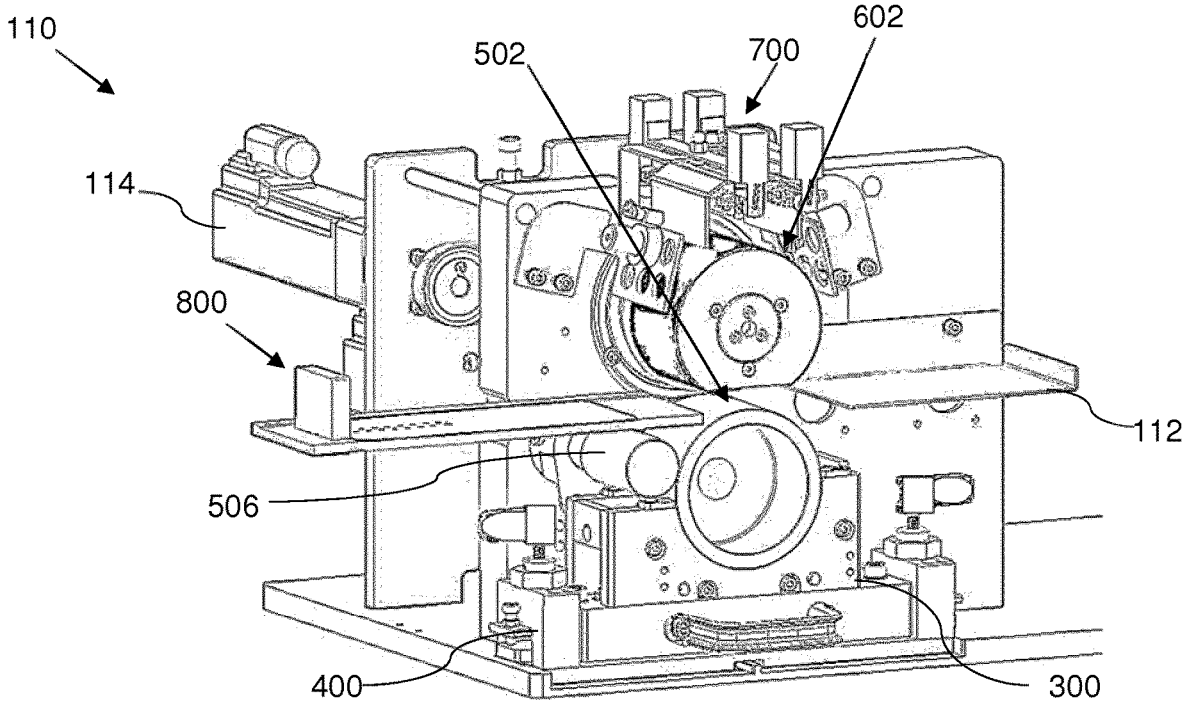
FIG. 11 shows another example of a print apparatus.

FIG. 11 shows an example of a print apparatus 110 comprising the components described in FIGS. 3 to 8, assembled together, and which may comprise an example of a color proofing apparatus. In addition to the components described above, the print apparatus 110 further comprises a substrate receiving tray 112, on to which a printed substrate may be provided and a motor 114.

As the print apparatus 110 lacks a photoconductive surface and the associated apparatus such as laser arrays, charging rollers and the like, and/or print heads and the like it may be considerably smaller than other print apparatus. It may therefore provide quick 'proof' prints for print agent mixtures and the like. This may in turn shorten the period of time for adjusting a print agent composition, which may take several iterations. Moreover, its relatively small form factor means it need not occupy excessive counter space or storage space.

Aspects of some examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims and/or other dependent claim(s).

The invention claimed is:

1. A method comprising:

imparting an electrostatic charge to print agent in a print agent reservoir;

acquiring the print agent from the print agent reservoir to form a print agent layer on a first print agent transfer member;

transferring the print agent layer directly from the first print agent transfer member to a second print agent transfer member;

applying the print agent layer directly from the second print agent transfer member to a substrate; and determining a colorimetry of the print agent on the substrate.

2. The method according to claim 1 further comprising determining an adjustment to a print agent mixture based on the colorimetry.

3. A print apparatus comprising:

a print agent cell comprising an electrode and a void, wherein the electrode is to impart an electrostatic charge to a print agent within the void;

a first print agent transfer member to acquire a layer of print agent from the print agent cell;

a second print agent transfer member to receive the layer of print agent from the first print agent transfer member and to transfer the layer of print agent to a substrate; and an adjustable mounting for mounting the second print agent transfer member such that a pressure between the first print agent transfer member and the second print agent transfer member is adjustable.

4. The print apparatus according to claim 3 in which the first print agent transfer member is a cylindrical drum and the void of the print agent cell is shaped so as to follow a circumference of a portion of the first print agent transfer member.

5. The print apparatus according to claim 4 in which the void is defined between the electrode, sidewalls and the first print agent transfer member.

6. The print apparatus according to claim 5 in which the print agent cell comprises a print agent inlet and a print agent overflow wherein the print agent inlet is situated higher than the print agent overflow.

7. The print apparatus according to claim 3 further comprising a squeegee roller, wherein the squeegee roller is to form a nip with the first print agent transfer member.

8. The print apparatus according to claim 3 in which the second print agent transfer member comprises a cylindrical body having a flattened circumferential portion.

9. The print apparatus according to claim 3 further comprising heating apparatus, wherein the heating apparatus is to heat at least a portion of the second print agent transfer member.

10. The print apparatus according to claim 9 in which the second print agent transfer member comprises a core, a thermal insulation layer, and an outer layer, wherein the thermal insulation layer is to limit heat transfer from the outer layer to the core.

11. The print apparatus according to claim 3 further comprising a substrate handling apparatus to introduce the substrate between the first and second print agent transfer members.

12. The print apparatus according to claim 11 in which the substrate handling apparatus comprises a tray having a manually operated push plate.

13. Color proofing apparatus comprising:

a fluid reservoir for receiving an electrostatic liquid ink composition, the fluid reservoir comprising an electrode to charge the electrostatic liquid ink composition;

a developer element having a surface to contact the electrostatic liquid ink composition within the fluid reservoir and acquire a layer of the electrostatic liquid ink composition;

an intermediate transfer member to receive the layer of the electrostatic liquid ink composition from the developer element and to transfer the layer to a substrate; and a substrate handling apparatus to insert the substrate between the intermediate transfer member and the developer element.

* * * * *